US011326584B2

(12) United States Patent
Alsadun

(10) Patent No.: US 11,326,584 B2
(45) Date of Patent: May 10, 2022

(54) PUMPING WATER AT A FLOW RATE EQUAL TO A FLOW RATE OF A COMPRESSED AIR FLOWING INTO A RESERVOIR HAVING A STOPPER

(71) Applicant: Maha Taleb Alsadun, Riyadh (SA)

(72) Inventor: Maha Taleb Alsadun, Riyadh (SA)

( * ) Notice: Subject to any disclaimer, the term of this patent is extended or adjusted under 35 U.S.C. 154(b) by 111 days.

(21) Appl. No.: 16/732,827

(22) Filed: Jan. 2, 2020

(65) Prior Publication Data

US 2020/0217308 A1 Jul. 9, 2020

(51) Int. Cl.

| | |
|---|---|
| ***F04B 9/123*** | (2006.01) |
| ***F04B 23/02*** | (2006.01) |
| ***F04B 7/00*** | (2006.01) |
| ***F04B 53/06*** | (2006.01) |
| *F04B 19/22* | (2006.01) |

(52) U.S. Cl.

CPC ..... *F04B 9/123* (2013.01); *F04B 7/0046* (2013.01); *F04B 23/02* (2013.01); *F04B 53/06* (2013.01); *F04B 19/22* (2013.01); *F04B 23/026* (2013.01); *F04B 2205/09* (2013.01); *F05B 2210/11* (2013.01); *F05B 2210/12* (2013.01); *F05B 2220/32* (2013.01); *F05B 2220/62* (2013.01)

(58) Field of Classification Search

CPC ..... F04B 9/123; F04B 23/026; F04B 9/12; F04B 7/0007; F04B 7/0046; F04B 19/003; F05B 2220/62; F05B 2210/12; F05B 2210/11

USPC ..... 137/211.5

See application file for complete search history.

(56) References Cited

U.S. PATENT DOCUMENTS

| | | | | |
|---|---|---|---|---|
| 2,688,923 | A * | 9/1954 | Bonaventura | F03G 6/06 417/379 |
| 3,786,966 | A * | 1/1974 | Behunin | F04B 9/127 222/387 |
| 4,587,133 | A * | 5/1986 | Shannon | B05D 7/20 427/117 |
| 4,976,546 | A * | 12/1990 | Beattie | B01F 3/088 222/135 |
| 6,009,892 | A * | 1/2000 | Martinitz | B01D 21/0024 137/1 |
| 6,313,545 | B1 * | 11/2001 | Finley | H02K 7/1823 290/54 |
| 2007/0213191 | A1 * | 9/2007 | Chammas | B04B 5/0442 494/41 |
| 2009/0188865 | A1 * | 7/2009 | Oklejas, Jr. | C02F 1/441 210/651 |

(Continued)

*Primary Examiner* — Nathan C Zollinger
*Assistant Examiner* — Timothy P Solak
(74) *Attorney, Agent, or Firm* — Sughrue Mion, PLLC

(57) ABSTRACT

An apparatus may include a reservoir; a stopper dividing the reservoir; a water fill pipe configured to provide the water to a lower portion of the reservoir; and an outlet pipe connected to the lower portion of the reservoir. The apparatus may further include a compressed air feed pipe which may provide compressed air to an upper portion of the reservoir to press on the stopper so that the water is forced by the stopper to escape from the lower portion of the reservoir through the outlet pipe. A processor included in the apparatus may be configured to determine a water pumping rate of the water while the water escapes through the outlet pipe, and to control the compressed air feed pipe to provide the compressed air at an air pumping rate equal to the water pumping rate.

20 Claims, 3 Drawing Sheets

(56) References Cited

U.S. PATENT DOCUMENTS

2017/0122284 A1* 5/2017 Mesinger ..... F03B 17/025

* cited by examiner

PUMPING WATER AT A FLOW RATE EQUAL TO A FLOW RATE OF A COMPRESSED AIR FLOWING INTO A RESERVOIR HAVING A STOPPER

CROSS-REFERENCE TO RELATED APPLICATION

This application claims priority from GCC Application No. GC 2019-36849, filed on Jan. 5, 2019, in the Gulf Corporation Council Patent Office, the disclosure of which is incorporated herein by reference in its entirety.

FIELD

The present disclosure relates to a reservoir for compressing and pumping water in order to convert compressed air energy to liquid-compression energy at the compression rate required for usage.

BACKGROUND

Currently used high-pressure pumps for in reverse osmosis desalination plants consume a large amount energy. Published studies have shown that the consumption rate of current pumps ranges between 5-8 kW per cubic meter. Because the consumption of domestic water is also high in many countries, for example about 8 million cubic meters per day in many countries, energy consumption of such pumps will be very high.

In addition, water turbines used for electricity generation also use a large amount of water.

Accordingly, there is a need for greater efficiency in pumping water.

SUMMARY

In accordance with an aspect of the disclosure, an apparatus for compressing and pumping water includes a reservoir configured to hold the water; a stopper slidably disposed within the reservoir and configured to divide the reservoir into an upper portion and a lower portion, wherein the stopper comprises a closable vent; a water fill pipe configured to provide the water to the lower portion of the reservoir when the stopper is in a raised position; an outlet pipe connected to the lower portion of the reservoir; a compressed air feed pipe connected to the upper portion of the reservoir and configured to provide compressed air from a compressor to the upper portion of the reservoir while the vent of the stopper is closed, such that the compressed air presses on the stopper and the water is forced by the stopper to escape from the lower portion of the reservoir through the outlet pipe; and at least one processor configured to determine a water pumping rate of the water while the water escapes through the outlet pipe, and to control the compressed air feed pipe to provide the compressed air at an air pumping rate equal to the water pumping rate, wherein the stopper is configured to separate the compressed air from the water and prevent evaporation of the water.

The outlet pipe may be configured to feed the water to at least one from among a reverse osmosis desalination apparatus or a water turbine.

The apparatus may further include a pressure sensor configured to sense the air pumping rate of the compressed air; and a valve, and the at least one processor may be configured to control the pumping rate of the compressed air based on the sensing using the valve.

The apparatus may further include at least one water sensor configured to detect that all of the water has escaped from the lower portion, based on the detecting, the processor may be configured to control the vent to open and allow the compressed air to escape through the outlet pipe.

The stopper may include an upper face rotatably engaged with a lower face, the vent may include a first recess disposed in the upper face and a second recess disposed in the lower face, and wherein the vent may be opened by rotating the upper face with respect to the lower face until the first recess coincides with the second recess.

The stopper may be configured to contact a surface of the water.

The stopper may be configured to slide from the raised position to a lowered position as the water escapes from the outlet pipe such that the stopper remains in contact with the surface of the water.

The apparatus may further include a winch configured to lift the stopper from the lowered position the raised position after the compressed air escapes through the outlet pipe.

The reservoir may be constructed from at least one of steel and concrete.

The reservoir may include a lake enclosed by the at least one of the steel or the concrete.

In accordance with an aspect of the disclosure, a method of compressing and pumping water includes raising a stopper slidably disposed within a reservoir to a raised position, wherein the stopper may be configured to divide the reservoir into an upper portion and a lower portion, and comprises a closable vent; providing the water through a water fill pipe to the lower portion of the reservoir while the stopper is in the raised position; providing compressed air from a compressor through a compressed air feed pipe to the upper portion of the reservoir while the vent of the stopper is closed, such that the compressed air presses on the stopper and the water is forced by the stopper to escape from the lower portion of the reservoir through an outlet pipe; determining a water pumping rate of the water while the water escapes through of the outlet pipe; and controlling the compressed air feed pipe to provide the compressed air at an air pumping rate equal to the water pumping rate, wherein the stopper is configured to separate the compressed air from the water and prevent evaporation of the water.

The outlet pipe may be configured to feed the water to at least one from among a reverse osmosis desalination apparatus or a water turbine.

The method may further include sensing the air pumping rate of the compressed air using at least one sensor; and controlling the pumping rate of the compressed air based on the sensing using a valve disposed in the compressed air feed pipe.

The method may further include detecting that all of the water has escaped from the lower portion using at least one water sensor; and based on the detecting, controlling the vent to open and allow the compressed air to escape through the outlet pipe.

The stopper may include an upper face rotatably engaged with a lower face, the vent may include a first recess disposed in the upper face and a second recess disposed in the lower face, and the vent may be opened by rotating the upper face with respect to the lower face until the first recess coincides with the second recess.

The stopper may be configured to contact a surface of the water.

The stopper may be configured to slide from the raised position to a lowered position as the water escapes from the outlet pipe such that the stopper remains in contact with the surface of the water.

The method may further include lifting the stopper using a winch from the lowered position the raised position after the compressed air escapes through the outlet pipe.

The reservoir may be constructed from at least one of steel and concrete.

According to an aspect of the disclosure, a non-transitory computer-readable medium may store instructions which, when executed by at least one processor of a device for compressing and pumping water, cause the at least one processor to: control the device to raise a stopper slidably disposed within a reservoir to a raised position, wherein the stopper may be configured to divide the reservoir into an upper portion and a lower portion, and comprises a closable vent; control a water fill pipe to provide the water to the lower portion of the reservoir while the stopper is in the raised position; control a compressed air feed pipe to provide compressed air from a compressor to the upper portion of the reservoir while the vent of the stopper is closed, such that the compressed air presses on the stopper and the water is forced by the stopper to escape from the lower portion of the reservoir through an outlet pipe; determine a water pumping rate of the water while the water escapes through of the outlet pipe; and controlling the compressed air feed pipe to provide the compressed air at an air pumping rate equal to the water pumping rate, wherein the stopper is configured to separate the compressed air from the water and prevent evaporation of the water.

BRIEF DESCRIPTION OF THE DRAWINGS

Further features, the nature, and various advantages of the disclosed subject matter will be more apparent from the following detailed description and the accompanying drawings in which.

DETAILED DESCRIPTION

Figure 1:
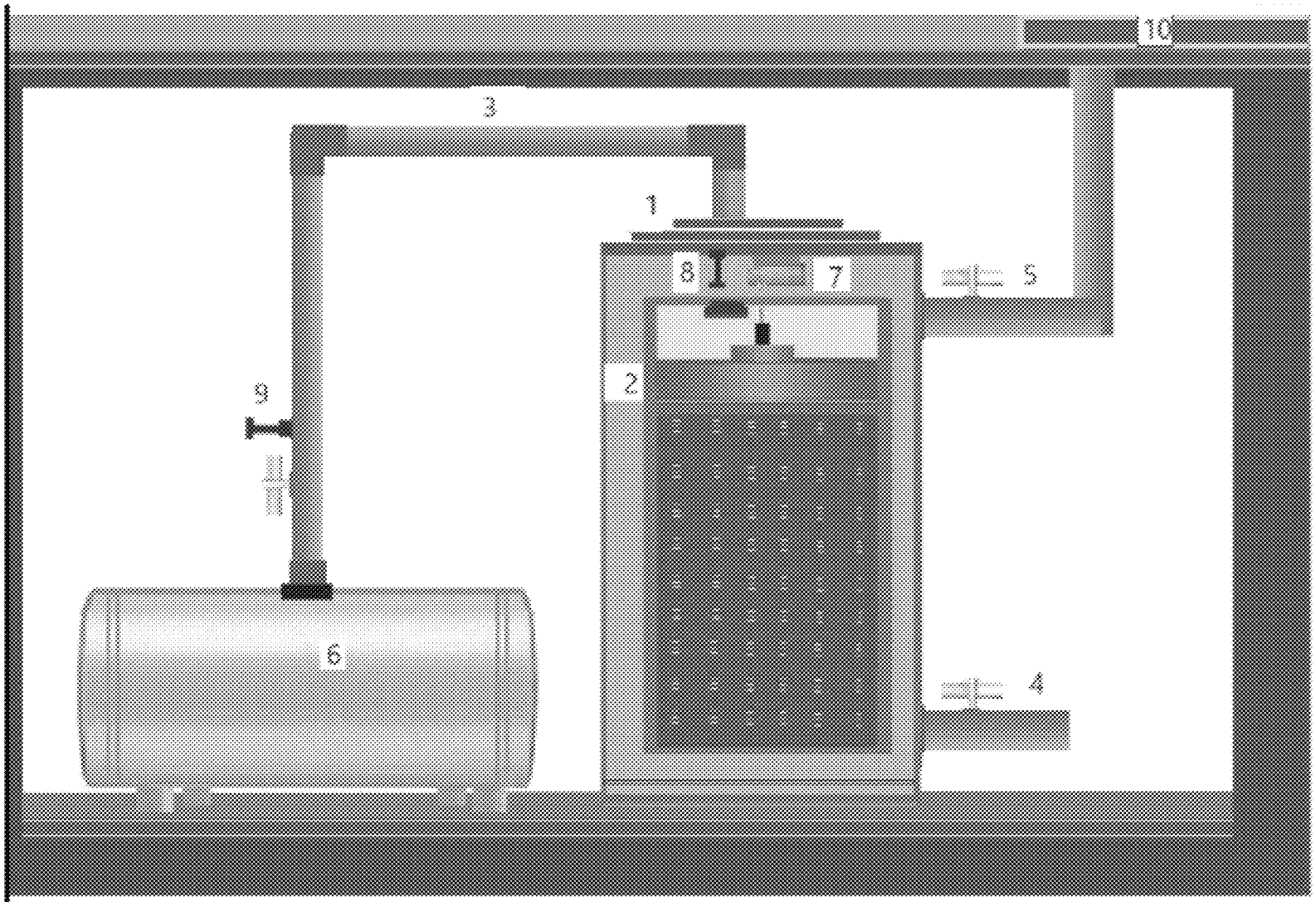
FIG. 1 illustrates a general view of a reservoir for compressing and pumping when the reservoir is filled with water, according to an embodiment.

The present disclosure relates to a reservoir used for converting compressed air energy to a water-compressing and pumping energy at the required usage rate. In an embodiment, the reservoir may be, for example, a tank. The reservoir may be pre-manufactured/constructed, or may be a reservoir resulting from turning natural and man-made lakes into reservoirs by surrounding them with a strong construction that isolates them from the outer environment. The reservoir walls may be strong enough to bear extremely high pressures. In an embodiment, the reservoir may be filled with water and a small space, for example several centimeters, may be left between the water surface and the reservoir top. When compressed air is pumped at high-pressure rates into the space, the air pressure increases gradually, and the pumping of air may proceed until the air-compressing rate reaches a predetermined value. Then, the pressure may be transferred to the water, where the water compressing rate may be equal to the air compressing rate in the space, which may be equal to the required rate for usage. Then, the water is ready to be pumped to the end user.

According to an embodiment, the water may be provided to a reverse osmosis desalination plant at the required usage rate with limited energy consumption. According to another embodiment, the water may be provided to a water turbine to generate electricity with minimum energy consumption. According to embodiments, liquids may be compressed at the compression rate required for usage.

According to an embodiment, a reservoir may be used to convert compressed air energy to a water-compressing energy that is used to compress and pump water onto a water turbine at a rate suitable for generating electricity using a limited operating energy, or used to compress and pump water for reverse osmosis desalination plants at an appropriate pressure rate, for example 50-80 bars, using less energy than high-pressure pumps. The reservoir can also compress and pump liquids generally at the required pressure rate and with a limited energy.

According to an embodiment, energy may be converted from a compressed air energy to an energy for pumping water.

According to an embodiment, the water to be used for one or more working day may be compressed together at the required usage rate.

According to an embodiment, an unchanged pressure rate may be maintained in the water even when the amount of water in the reservoir decreases during pumping, and until the last drop exits from the reservoir.

According to an embodiment, an amount of water to be compressed and pumped for example daily may be controlled by customizing the size and dimensions of the reservoir.

Accordingly, the disclosed embodiments may be a very good alternative to high pressure pumps, and may provide greater energy in view of the general consumption of the reverse osmosis system of water desalination. The disclosed embodiments may also be used to generate electricity by pumping compressed water on a water turbine at a pressure rate that allows generating electricity efficiently.

FIG. 1 illustrates a general view of a reservoir (1), which may be an example of reservoirs disclosed above, when the reservoir 1 is filled with water. As can be seen in FIG. 1, a small space, which may be for example several centimeters, may be left between the surface of the water and the top of reservoir (1).

Figure 2:
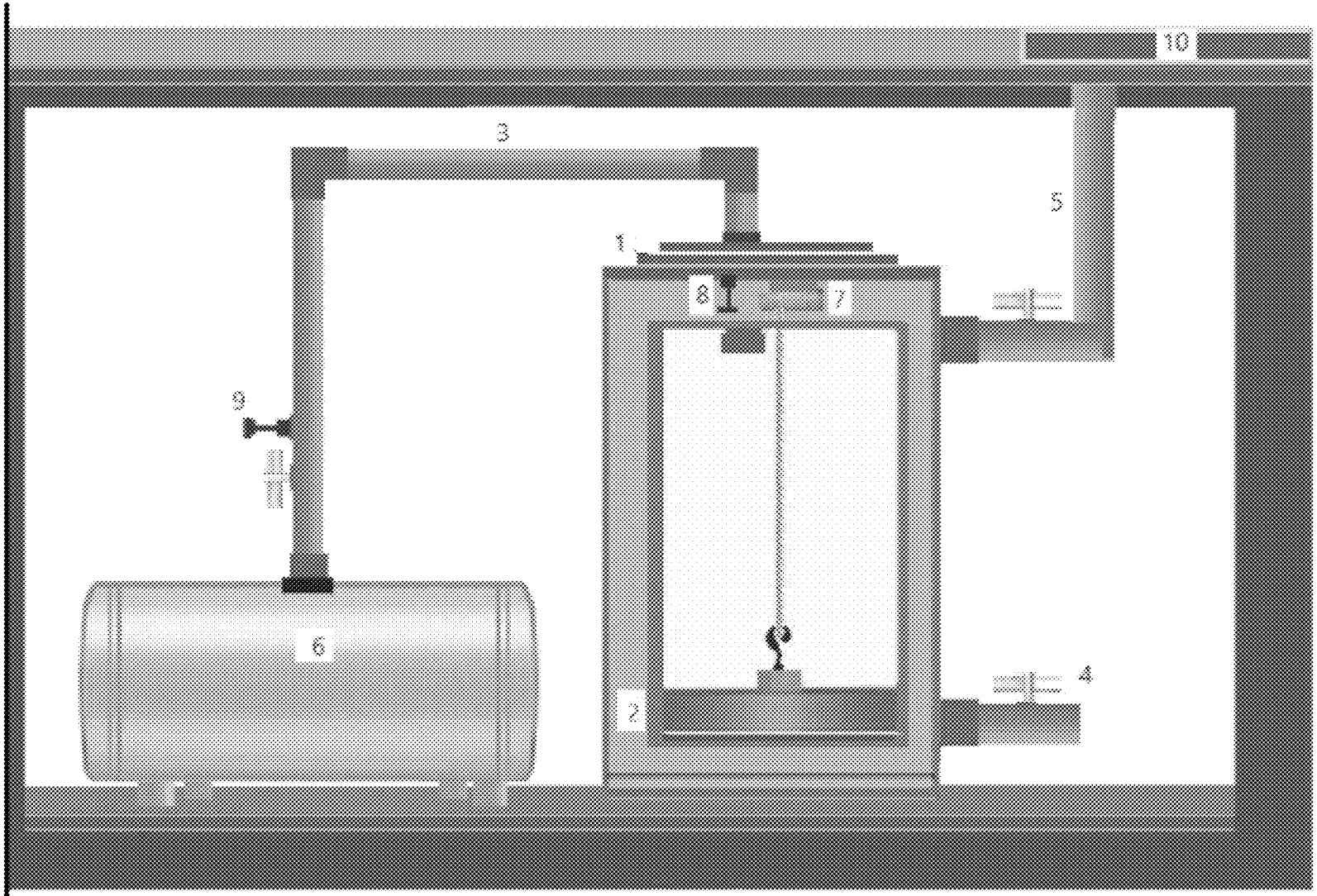
FIG. 2 illustrates a general view of a reservoir for compressing and pumping when the reservoir is emptied of water, according to an embodiment.

FIG. 2 illustrates a general view of the reservoir (1) and its components after pumping all the water to the end user. As can be seen in FIG. 2, the crane (7) may pull the stopper (2) from the bottom of the reservoir (1) upward near the top thereof.

According to an embodiment, a reservoir (1) may be made of steel of suitable size that withstands very high pressures. The reservoir (1) according to an embodiment uses compressed air for compressing and pumping water to end user. The reservoir (1) may have an amount of inside water may be equal to the amount of water to be compressed and pumped in a full working day as a minimum. The reservoir (1) according to an embodiment may include all amount of water required in a full working day (altogether) at a pressure rate that does not change as the water decreases in the reservoir during pumping.

According to an embodiment, a stopper (2) may be made of strong metal, and may be highly pressurized, floatable, and serve as a piston for water compression. The stopper (2) according to an embodiment is also used to separate reservoir water from the compressed air so that the reservoir water does not evaporate due to high temperature of the compressed air.

According to an embodiment, a pipe (3) may be made of steel, and may be equipped with an opening/closing valve, attached to a sensor and used to supply the space between the water surface and the top of the reservoir with compressed air before the start of work. The compressed air is pumped into the space until the rate of air pressure reaches the rate required for use. During pumping the compressed water to the end user, the water inside the reservoir decreases and the space above the surface of the water increases. Consequently, the air expands, its pressure is reduced. Then, the sensor makes the pipe pump the compressed air at a rate that is equal to the flow rate of water from the reservoir, maintaining the pressure rate constant in the reservoir water as of the water is pumped until the entire water exits the reservoir.

According to an embodiment, a pipe (4) may be made of steel, and may be positioned below one side of the reservoir (1) and have an opening/closing cock used when opening the cock to pump compressed water from the reservoir (1) to the end user.

According to an embodiment, pipe (5) may be made of iron or a water pipe, and may be equipped with a valve for opening and closing and used to supply the reservoir with saline water from the source before starting operation of the unit.

According to an embodiment, an air compressor (6) may be used to pump the compressed air to the reservoir via the pipe (3) into the space within the reservoir at the required usage pressure rate.

According to an embodiment, a winch or pulling crane (7) with rope attached to the top of the stopper (2) may be used after the completion of pumping all the water of the reservoir to lift the stopper from the bottom of the reservoir close to the top of the reservoir.

According to an embodiment, a sensor (8) may be used to open the recess of the stopper to get out the compressed air through the recess of the stopper it-after pumping water from the reservoir.

According to an embodiment, a sensor (9) may be used to regulate the pumping rate of the compressed air during pumping water so that the air pumping rate to the reservoir space equals the rate of pumping water out of the reservoir.

Embodiments of the present disclosure may be used to overcome problems such as the high energy consumed by high-pressure pumps in reverse osmosis plants, which may be about 5-8 kW per cubic meter of water. The energy consumption of embodiments such as reservoir (1) may be limited in comparison to the consumption of high-pressure pumps. The reservoir (1), according to an embodiment, may have the advantage of converting the energy of compressed air into energy for compressing and pumping water. This may increase production at the expense of operational energy, whether in terms of reverse osmosis water desalination or in terms of generating electricity from a water turbine. The operational energy may be very low because it is limited by the air pressure in a space having a simple and limited size. Therefore, a limited energy may be consumed for compressing air in such space and as a result this high pressure generated by low energy will be equally transferred to all the parts of the water reservoir. Embodiments of the disclosure may allow for compressing a great amount of water at a high pressure rate with limited energy consumption for compressing air pressure within a limited space. Thus, a definite mechanical profit may be achieved for the production by converting the compressed air energy in a limited space into energy for compress a large amount of water at the pressure required for use, according to an embodiment.

Referring again to FIGS. 1-2, according to an embodiment reservoir (1) may be made of concrete, steel, or materials of gas cylinders that withstand very high pressures. The reservoir (1) can be square, rectangular or cylindrical in shape. The size and dimensions of reservoir (1) may be determined according to the amount of water to be pumped in a full working day (8-12 hours) or the amount of water required in (24 hours) or more. The walls of reservoir (1) may be not heat conductive, and may be, for example, lined or padded with insulating material. Prefabricated reservoirs may be used for small, medium and large units that can be constructed above ground or underground in specific dimensions and of recognized building materials that withstand very high pressures (as walls, floors and roofs). Natural or man-made lakes can be transformed to reservoirs by surrounding them with a strong construction, separating them from the outer environment and attaching them to the remaining components. Thus they may serve as a reservoir (1) according to an embodiment.

When reservoir (1) is manufactured or constructed, the size may accommodate the amount of water to be compressed and pumped in a (minimum) full working day. The space height may be precisely determined by precise mathematical equations related to the operating energy consumption for water compression and pumping at the usage pressure rate.

Referring again to FIGS. 1-2, stopper (2) may be placed above the surface of the reservoir water and is in the form of a piston and performs its function in terms of pressure on the water, according to an embodiment. Stopper (2) according to an embodiment may be made of heat-insulating metals or other heat-insulating materials and should be strong to withstand very high pressures. Stopper (2) according to an embodiment may be used to prevent the heat of compressed air from reaching the water so that it does not heat up and evaporate. When installed on the surface of the reservoir water, there may be is a small space above its surface extending from the surface of the stopper to the top of the reservoir. This space may be filled with compressed air at the rate of pressure required for use. The air presses the stopper that presses the water. Thus the pressure is transferred to the water inside the reservoir. Stopper (2) according to an embodiment may be made of very strong metals that are less dense than water in order to float above the reservoir water. Stopper (2) according to an embodiment may include two pieces: one serves as a (face) and the other underneath serves as a (floor); and both of them may have a circular recess. If the upper piece rotates a half turn, the lower recess may be shown immediately under the upper one. The stopper becomes open from one side. According to an embodiment, the two pieces have one sensor and they are in operation when the entire water exit the reservoir. This drives the sensor making the upper piece rotates and the recess is revealed. Once the recess appears, the compressed air flushes through it above the stopper. It enters through the recess downwardly where it comes out of the water pump pipe. Because the reservoir cannot be filled with water again unless the compressed air exits and the stopper is lifted, the reservoir may then be filled with water in preparation for a new duty cycle.

A pipe (3) according to an embodiment may be made of steel that withstands high pressure. Pipe (3) according to an embodiment may be attached from one end to the top of the reservoir and from the far end to the source of pumping the compressed air. Pipe (3) according to an embodiment may be equipped with a valve attached to a sensor and a processor regulating the process of pumping compressed air into the reservoir and maintaining a constant pressure. Through this pipe (3) the compressed air is pumped into the space in the reservoir and the pumping continues until the rate of air pressure inside the space reaches the rate required for use. Then pumping is stopped. The pressure may be transmitted through the stopper (2) to the water of the reservoir and the water becomes compressed at the pressure rate required for usage and then it is pumped to the end user. In conjunction with the pumping of water to the user, the water inside the reservoir decreases and the space above the surface of the water expands, resulting in the expansion of the compressed air in the space. Once pumping water starts, the sensor and processor begin to control pumping they compressed air through the pipe (3), wherein the rate of pumping compressed air in the reservoir space equals the rate of pumping water to the outside of the reservoir. Thus, the rate of air and water compression remains unchanged as of the moment of pumping water until the entire water is out of the reservoir.

A compressed water pumping pipe (4) according to an embodiment may be made of steel, attached to the bottom of the reservoir (1) and equipped with a cock for opening/closing. On operation, the cock is opened, then the water strongly flows via the pipe to the end user. The dimensions of the pipe are technically determined to allow the required flow rate per second and minute.

A feeding pipe (5) may be made of iron or existing water pipes having suitable size. Feeding pipe (5) may supply the reservoir with water from source after work has been done in preparation for a new working day.

An air compressor (6) may be selected from commercially available electric compressors and according to its ability to compress the air at the required rate.

A pulling crane (7) may be selected from commercially available equipment such as a winch according to an embodiment. According to an embodiment, pulling crane (7) works after the water is pumped and exit from the reservoir to lift the stopper (2) from the bottom of the reservoir to near its top as shown in FIG. 2). Then the reservoir is refilled with saline water in preparation for a new work cycle. At the start of a new work cycle, the crane (7) lowers the stopper (2) to float on the surface of the water in the reservoir.

A sensor (8) according to an embodiment may be used to open the recess of the stopper to eject the compressed air after pumping the water from the reservoir.

A sensor (9) according to an embodiment may be used regulate the rate of pumping compressed air during pumping the water so that the rate of air pumped to the reservoir space equals the rate of pumping water out of the reservoir.

A source of water (10) according to an embodiment may supply the reservoir with water to be compressed and pumped. It can be a sea water or any other source, as desired.

An example of operating reservoir (1) according to an embodiment is described below. The air compressor (6) is operated and the compressed air is pumped through the pipe (3) into the space at the top of the reservoir (1). The pumping continues until the air pressure rate inside the reservoir space reaches the usage rate required for stopping the pumping of air. Then, the compressed air strongly presses the stopper (2) that presses, in its turn, on the reservoir water. Therefore, the pressure is transferred to the reservoir water and the water pressure is equal to that of the compressed air. The cock of the pumping pipe (4) is opened and the water is pushed strongly via the pipe (4) and is directed to the end user at the required usage pressure rate. As water pumping continues, the volume of water inside the reservoir decreases and the space increases, resulting in the expansion of compressed air within the reservoir space (proportionally) with water decrease. That is, the less the water in the reservoir as a result of pumping, the more the space and the air expand and the less its pressure becomes. Since the pipe (3) is attached to the sensor (9), the latter will control the rate of pumping compressed air in the reservoir space as from the moment of pumping out the water. Thus, the compressed air is pumped (at a rate that equals the rate of water flow and pumping), so the pressure remains constant in the reservoir space and unchanged in the reservoir water from the moment the water is pumped out of the reservoir until the entire water comes out of the reservoir.

After pumping the entire reservoir water to the end user, the stopper (2) is located at the bottom of the reservoir and the compressed air is above it. The sensor (8) connected to the stopper causes the upper surface of the stopper to rotate a half turn, opening the stopper recess and pushing the compressed air through the recess downwardly, where it comes out of the water pumping pipe. After the air is released, the crane (7) lifts the stopper from the bottom of the reservoir to its top. Then the feeding pipe (5) opens its cock and fill the reservoir with saline water in preparation for a new working day. After filling, crane lowers the stopper above the water surface and the reservoir is ready for a new working day.

An example of an embodiment of reservoir (1) which may be used in reverse osmosis desalination plants at pressure of 80 bar is described below.

The reservoir (1) may have a length of 20 m, width of 20 m, height of 10 m and size of $=20\times20\times10=4000\ m^3$. The reservoir (1) may be filled with water leaving a small space (5 cm). Thus, the size of the space$=20\times20\times0.05=20\ m^3$.

On operation, compressed air is pumped into the space. Pumping compressed air in the space continues until the rate of air pressure in the space reaches the required rate for use (80 bars).

The pressure moves from the compressed air in the space to the water in the reservoir; the rate of water pressure inside the reservoir equals 80 bar.

The cock of the pumping pipe is opened and the water is pushed to the end user at a pressure rate of 80 bars When the water inside the reservoir decreases the space increases, which results in the expansion of the compressed whose pressure decreases accordingly (in proportion with) the water decrease. That is to say, the less water, the more the air expands and the less its pressure becomes. Then, the sensor (9) connected to the pipe (3) is used to control the rate of pumping compressed air in the reservoir space. The rate of compression the compressed air equals the rate of water flow from the reservoir. Thus, the pressure is constant and unchanged both in the space of the reservoir from the moment of pumping water until the entire water comes out of the reservoir.

In the current pumping systems of reverse osmosis desalination plants, the pumps consume a minimum of (5 kW for compressing and pumping a cubic meter) at a pressure rate of (50-80 bar). That is to say, the total consumption for compressing and pumping ($4000\ m^3$) in the pumping system is (20,000 kW). In the present invention, however, the energy required to compress and pump ($4000\ m^3$)=the energy required to compress air at a pressure rate of 50-80 bars in a space volume of ($20\ m^3$ only), i.e. we will use energy to operate an air compressor having the capacity (80 bars) to fill a space size of ($20\ m^3$). According to all standards, the energy consumption using compressed air will be much less than the energy consumed by the pumps.

Embodiments of the present disclosure provide a good alternative to high-pressure pumps that consume (5-8) kilowatts to pump a cubic meter of water to reverse osmosis plants, and can be pumped at the required pressure rate saving a lot of energy.

Embodiments of the present disclosure may compress any large amount of water at once at the pressure rate t required for usage whatever the size of this water may be via controlling the pressure rate of air in the reservoir space then pump it in a full working day or in several working days.

Embodiments of the present disclosure may be unaffected by the salt concentration of water and the operational energy unaffected by the reverse of the pumps, which require more energy consumption as the salt concentration increases.

Embodiments of the present disclosure may be used to compress and pump water on a water turbine to generate electricity with limited operating energy.

Embodiments of the present disclosure may compress liquids in general at the pressure required for usage and with less energy consumption compared to the current compressors.

According to an embodiment, there is provided a (compression/pumping) reservoir made of steel, concrete or construction materials that withstand very high pressures, that is used for converting compressed air energy into an energy for pumping water, and is either pre-manufactured or constructed (above/below) the ground surface with usable dimensions. The reservoir can be a natural water reservoir (natural or man-made lakes) surrounded by strong construction, isolated from the outer environment and can be attached to the components of the invention to become the reservoir of the invention. Said reservoir is filled with water and covered by a stopper that serves as piston that covers the entire water surface. A small space is left (estimated in centimeters) between the upper surface of the stopper and the top of the reservoir. Compressed air is pumped in the small space at high rates and the pumping continues in the space until the air pressure rate becomes equal to the rate required for compressing water in the reservoir; then, the compressed air presses the stopper which consequently presses the reservoir water and the pressure is transferred to the reservoir water. Thus the rate of water compression may equal the rate required for usage. The water is pumped to the end user. In conjunction with water pumping, a sensor is used to control the pumping rate of air in the space making the pumping rate of the compressed air into the reservoir space (during water pumping) equal to the rate of pumping water from the reservoir; and as a result, the pressure remains unchanged as of the moment the water is pumped into the reservoir until the entire water comes out of it.

According to an embodiment, the reservoir may include a reservoir (1) used for converting compressed air energy into an energy for compressing and pumping water at the required usage rate.

According to an embodiment, the reservoir may include a stopper (2) in the form of a piston comprised of two pieces having recesses run by a sensor and a processor; if the upper surface turns a half turn, the two recesses coincide making the stopper hollow from one of its sides. The stopper is used to separate water from the compressed air and prevent air heat from reaching water so that it will not be heated up and vaporized. It is also used after water pumping is completed to allow the compressed air to pass through it and exit via a water pumping pipe.

According to an embodiment, the reservoir may include a pipe (3) whose cock is attached to a sensor, wherein it is used to pump the compressed air into the reservoir space until the air pumping rate reaches the rate required to compress the water so that the pumping rate is controlled via the sensor that makes the pumping rate of the compressed air equal to the pumping rate of the water. The pressure rate remains constant into the reservoir space and in water during water pumping.

According to an embodiment, the reservoir may include a pipe (4) under the compression reservoir that is used to pump the compressed water to the end user.

According to an embodiment, the reservoir may include a pipe (5) above one side of the reservoir used to feed and fill the reservoir with water that is to be compressed and to pump it all working day long.

According to an embodiment, the reservoir may include a compressor (6) used to pump the compressed air at the required pressure rate into the reservoir space.

According to an embodiment, the reservoir may include a winch or crane (7) used after completing water pumping to lift the stopper (2) from the reservoir bottom to its mouth.

According to an embodiment, the reservoir may include a sensor (8) used after the water has been pumped and the stopper has reached the reservoir bottom so that it opens the stopper recess to allow the compressed air exit the recess and is directed to the water pumping pipe to be ejected.

According to an embodiment, the reservoir may include a sensor (9) used to determine the pumping rate of the compressed air into the reservoir space in conjunction with pumping water from the reservoir, and as a result, the pumping rate of the compressed air equals water flow rate. Then the pressure remains unchanged from the moment of pumping water from the reservoir until the entire water comes out of the reservoir.

According to an embodiment, the reservoir may include a saline water source (10) supplying the reservoir with water that is to be compressed and pumping it to the end user.

Figure 3:
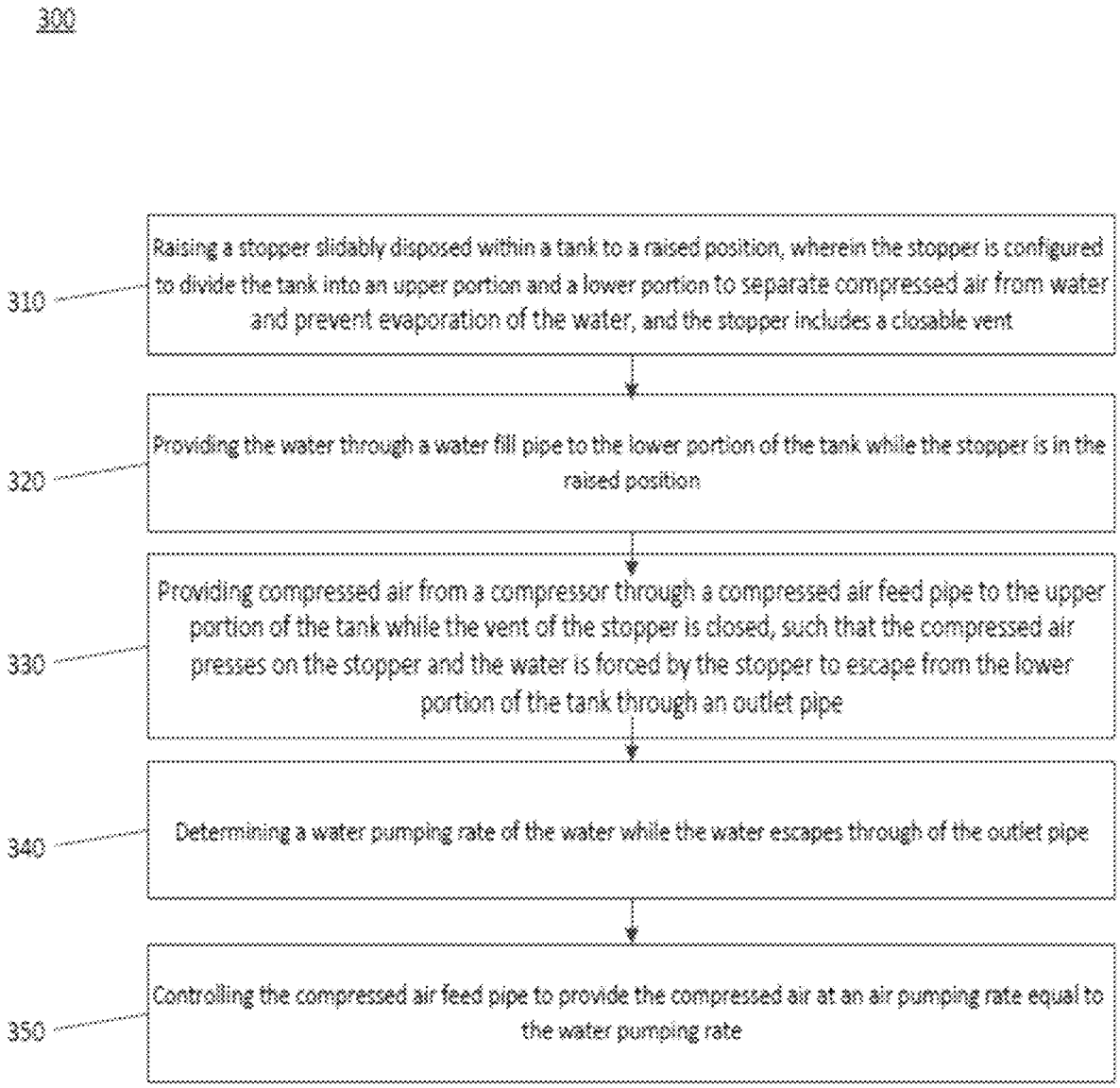
FIG. 3 is a flowchart of an example process of operating a reservoir for compressing and pumping water, according to an embodiment.

FIG. 3 is a flowchart is a flowchart of an example process 300 for compressing an pumping water according to an embodiment. In some implementations, one or more process blocks of FIG. 300 may be performed by reservoir (1). In some implementations, one or more process blocks of FIG. 300 may be performed by another device or a group of devices separate from reservoir (1).

As shown in FIG. 3, process 300 may include raising a stopper slidably disposed within a reservoir to a raised position, wherein the stopper is configured to divide the reservoir into an upper portion and a lower portion, and includes a closable vent (block 310).

As shown in FIG. 3, process 300 may include providing the water through a water fill pipe to the lower portion of the reservoir while the stopper is in the raised position (block 320).

As shown in FIG. 3, process 300 may include providing compressed air from a compressor through a compressed air feed pipe to the upper portion of the reservoir while the vent of the stopper is closed, such that the compressed air presses on the stopper and the water is forced by the stopper to escape from the lower portion of the reservoir through an outlet pipe (block 330).

As shown in FIG. 3, process 300 may include determining a water pumping rate of the water while the water escapes through of the outlet pipe (block 340).

As shown in FIG. 3, process 300 may include controlling the compressed air feed pipe to provide the compressed air at an air pumping rate equal to the water pumping rate (block 350).

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

While this disclosure has described several exemplary embodiments, there are alterations, permutations, and various substitute equivalents, which fall within the scope of the disclosure. It will thus be appreciated that those skilled in the art will be able to devise numerous systems and methods which, although not explicitly shown or described herein, embody the principles of the disclosure and are thus within the spirit and scope thereof

What is claimed is:

1. An apparatus for compressing and pumping water, the apparatus comprising:

a reservoir configured to hold the water;

a stopper slidably disposed within the reservoir and configured to divide the reservoir into an upper portion and a lower portion, wherein the stopper comprises a closable vent;

a water fill pipe configured to provide the water to the lower portion of the reservoir when the stopper is in a raised position;

an outlet pipe connected to the lower portion of the reservoir;

a compressed air feed pipe connected to the upper portion of the reservoir and configured to provide compressed air from a compressor to the upper portion of the reservoir while the vent of the stopper is closed, such that the compressed air presses on the stopper and the water is forced by the stopper to escape from the lower portion of the reservoir through the outlet pipe; and at least one processor configured to determine a water pumping rate of the water while the water escapes through the outlet pipe, and to control the compressed air feed pipe to provide the compressed air at an air pumping rate equal to the water pumping rate, wherein the stopper is configured to separate the compressed air from the water and prevent evaporation of the water.

2. The apparatus of claim 1, wherein the outlet pipe is configured to feed the water to at least one from among a reverse osmosis desalination apparatus and a water turbine.

3. The apparatus of claim 1, further comprising:

a pressure sensor configured to sense the air pumping rate of the compressed air; and a valve, wherein the at least one processor is configured to control the pumping rate of the compressed air based on the sensing using the valve.

4. The apparatus of claim 1, further comprising at least one water sensor configured to detect that all of the water has escaped from the lower portion, wherein, based on the detecting, the processor is configured to control the vent to open and allow the compressed air to escape through the outlet pipe.

5. The apparatus of claim 1, wherein the stopper comprises an upper face rotatably engaged with a lower face, wherein the vent is opened by rotating the upper face with respect to the lower face.

6. The apparatus of claim 1, wherein the stopper is configured to contact a surface of the water.

7. The apparatus of claim 6, wherein the stopper is configured to slide from the raised position to a lowered position as the water escapes from the outlet pipe such that the stopper remains in contact with the surface of the water.

8. The apparatus of claim 7, further comprising a winch configured to lift the stopper from the lowered position to the raised position after the compressed air escapes through the outlet pipe.

9. The apparatus of claim 1, wherein the reservoir is constructed from at least one of steel and concrete.

10. The apparatus of claim 9, wherein the reservoir comprises a lake enclosed by the at least one of the steel or the concrete.

11. A non-transitory computer-readable medium storing instructions which, when executed by at least one processor of a device for compressing and pumping water, cause the at least one processor to:

control the device to raise a stopper slidably disposed within a reservoir to a raised position, wherein the stopper is configured to divide the reservoir into an upper portion and a lower portion, and comprises a closable vent;

control a water fill pipe to provide the water to the lower portion of the reservoir while the stopper is in the raised position;

control a compressed air feed pipe to provide compressed air from a compressor to the upper portion of the reservoir while the vent of the stopper is closed, such that the compressed air presses on the stopper and the water is forced by the stopper to escape from the lower portion of the reservoir through an outlet pipe; and determine a water pumping rate of the water while the water escapes through the outlet pipe; and controlling the compressed air feed pipe to provide the compressed air at an air pumping rate equal to the water pumping rate, wherein the stopper is configured to separate the compressed air from the water and prevent evaporation of the water.

12. A method of compressing and pumping water, the method comprising:

raising a stopper slidably disposed within a reservoir to a raised position, wherein the stopper is configured to divide the reservoir into an upper portion and a lower portion, and comprises a closable vent;

providing the water through a water fill pipe to the lower portion of the reservoir while the stopper is in the raised position;

providing compressed air from a compressor through a compressed air feed pipe to the upper portion of the reservoir while the vent of the stopper is closed, such that the compressed air presses on the stopper and the water is forced by the stopper to escape from the lower portion of the reservoir through an outlet pipe;

determining a water pumping rate of the water while the water escapes through the outlet pipe; and controlling the compressed air feed pipe to provide the compressed air at an air pumping rate equal to the water pumping rate, wherein the stopper is configured to separate the compressed air from the water and prevent evaporation of the water.

13. The method of claim 12, wherein the outlet pipe is configured to feed the water to at least one from among a reverse osmosis desalination apparatus and a water turbine.

14. The method of claim 12, further comprising:

sensing the air pumping rate of the compressed air using at least one sensor; and controlling the pumping rate of the compressed air based on the sensing using a valve disposed in the compressed air feed pipe.

15. The method of claim 12, further comprising:

detecting that all of the water has escaped from the lower portion using at least one water sensor; and wherein, based on the detecting, controlling the vent to open and allow the compressed air to escape through the outlet pipe.

16. The method of claim 12, wherein the stopper comprises an upper face rotatably engaged with a lower face, wherein the vent is opened by rotating the upper face with respect to the lower face.

17. The method of claim 12, wherein the stopper is configured to contact a surface of the water.

18. The method of claim 17, wherein the stopper is configured to slide from the raised position to a lowered position as the water escapes from the outlet pipe such that the stopper remains in contact with the surface of the water.

19. The method of claim 18, further comprising lifting the stopper using a winch from the lowered position to the raised position after the compressed air escapes through the outlet pipe.

20. The method of claim 12, wherein the reservoir is constructed from at least one of steel and concrete.

* * * * *